United States Patent [19]

Burns

[11] 4,249,388

[45] Feb. 10, 1981

[54] AUTOMATIC LIQUID ICE SYSTEM

[75] Inventor: Daniel E. Burns, Camarillo, Calif.

[73] Assignee: Demco, Inc., Oxnard, Calif.

[21] Appl. No.: 116,820

[22] Filed: Jan. 30, 1980

[51] Int. Cl.[3] ..... F25D 25/04

[52] U.S. Cl. ..... 62/185; 62/60; 62/321; 62/330; 62/374; 141/159; 141/392; 53/505

[58] Field of Search ..... 62/321, 60, 330, 336, 62/354, 373, 374, 64, 185; 141/159, 392; 53/505, 506

[56] References Cited

U.S. PATENT DOCUMENTS

| | | | |
|---|---|---|---|
| 1,953,520 | 4/1934 | Vogt | 62/60 |
| 2,623,363 | 12/1952 | Williams, Sr. | 62/321 |
| 2,643,522 | 6/1953 | McLain | 62/321 |
| 2,901,891 | 9/1959 | Morrison | 62/60 |
| 3,004,395 | 10/1961 | Morris, Jr. | 62/330 X |
| 3,004,407 | 10/1961 | Morris, Jr. | 62/374 |
| 3,089,578 | 5/1963 | Saxe | 62/321 X |
| 3,250,086 | 10/1966 | Morris, Jr. | 62/64 X |
| 3,302,425 | 2/1967 | Morrison | 62/373 |
| 3,590,551 | 7/1971 | Riddington et al. | 53/505 X |

*Primary Examiner*—William E. Tapolcai, Jr.
*Attorney, Agent, or Firm*—Ralph B. Pastoriza

[57] ABSTRACT

The liquid ice system comprises an icing machine in the form of a compartment for receiving water and ice. Pulverizing means are provided for crushing the ice and uniquely oriented paddles stir the water and ice mixture to maintain a homogeneous mixture of liquid ice. A circulating conduit is provided in combination with a conveyor system and ice applicator devices connected to a portion of the conduit supported on an overhead structure of the conveyor. Boxes of vegetables or poultry are appropriately refrigerated for shipment by applying liquid ice to the boxes as they pass along the conveyor. Switches may be provided for automatically actuating the ice applicators when the box passes therebeneath. Important features of the invention include provision of stainless steel lining for the liquid ice compartment and associated valve, pipes and other equipment when the liquid ice is used for packing poultry and a unique probe constituting one of the liquid ice applicators suitable for re-icing as well as icing boxed or packaged items brought in from the field.

6 Claims, 4 Drawing Figures

AUTOMATIC LIQUID ICE SYSTEM

This invention relates generally to refrigeration of various items and more particularly to an automatic liquid ice system for refrigerating vegetables, poultry, fish and the like for preservation during shipment.

BACKGROUND OF THE INVENTION

It is well known in the art to refrigerate vegetables, poultry and the like to preserve the same during shipment or storage. Usually, specially designed cartons or boxes are provided for holding the vegetables or poultry and chipped ice is simply shovelled in the cartons to cover the contents. The cartons are sealed and normally transported in refrigerated railway cars or trucks to preserve them in an iced condition.

Problems associated with the foregoing procedures primarily result from non-uniform refrigeration of the contents of the box. Since the ice can only be applied to the top surface of the contents of the carton or box, there is not sufficient penetration through the various layers of vegetables or poultry to assure uniform cooling of all of the contents. Thus, while the first few layers may be cooled sufficiently, the lower layers may not meet the necessary requirements for proper refrigeration.

In the case of vegetables, the above problem has been solved by providing a mixture of ice and water in the form of a slurry or "liquid ice" which can then be poured over the top of the contents of a carton and will permeate fairly uniformly throughout the entire volume thereby providing greatly increased uniformity in the refrigeration. So far as I am aware, however, the use of such "liquid ice" for icing poultry has not heretofore ever been used. In the case of poultry, there are strict sanitation requirements which must be met. Thus, any system for providing liquid ice for use in poultry packing would have to meet such requirements.

Heretofore the application of "liquid ice" to vegetables and the like has been accomplished by hand and each individual carton is manipulated and filled by personnel at a work station. It would be helpful if this process could be automated. Further, while the use of "liquid ice" increases the penetration of the refrigerant throughout the volume of the vegetable, an improved arrangement whereby superior penetration could be achieved would be highly desirable particularly in reicing operations or in icing cartons brought in from the field.

BRIEF DESCRIPTION OF THE PRESENT INVENTION

With the foregoing considerations in mind, the present invention contemplates an improved automatic liquid ice system for refrigerating various items contained in cartons for shipment wherein problems associated with prior art methods are avoided.

More particularly, the present invention provides an icing machine for making liquid ice meeting appropriate standards so that such liquid ice can be used for packing poultry. Further, this icing machine works in combination with a conveyor system for automatically applying the liquid ice to items in boxes passed along the conveyor so that an automatic ice packing system results.

Specific features of this invention reside in the provision of stainless steel lining for the liquid ice machine compartment side walls, associated valves, pipes and other equipment coming into contact with the liquid ice; critical angulation of shafts with paddles for appropriate mixing and maintaining of the liquid ice in a homogeneous state; automatic switching arrangements on the conveyor means for assuring that a proper amount of liquid ice is received in each box passing thereunder in a fully automatic manner; and a unique probe construction constituting one type of liquid ice applicator to further increase penetration of the ice particularly useful in icing items already packaged in a carton.

BRIEF DESCRIPTION OF THE DRAWINGS

A better understanding of this invention will be had by now referring to the accompanying drawings in which.

DETAILED DESCRIPTION OF THE INVENTION

Figure 1:
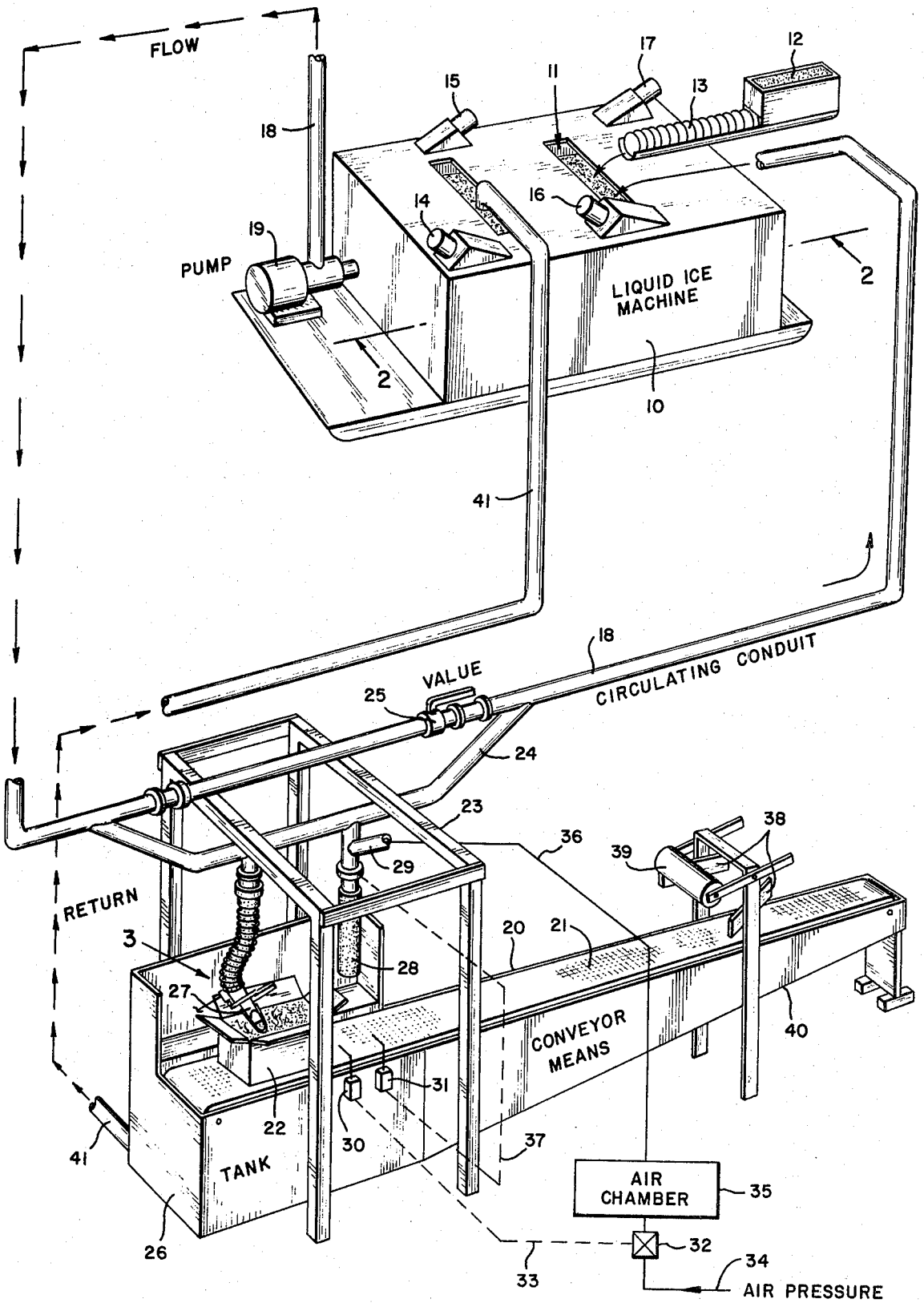
FIG. 1 is a highly schematic perspective view of basic components making up the automatic liquid ice system of my invention.

Referring to the upper portion of FIG. 1, the automatic liquid ice system of the present invention includes an icing machine 10 comprising, essentially, a large compartment indicated by the arrow 11 with appropriate overhead inlet means schematically indicated at 12 for receiving crushed ice. An auger screw 13 pulverizes the ice which is then mixed with water in the compartment 11. Appropriate agitating means in turn constantly stirs the water and ice slurry in the compartment 11 of the machine 10.

In the particular embodiment illustrated in FIG. 1, the agitating means comprise four individual drive motors 14, 15, 16 and 17 having shafts extending into the compartment at a given angle to the horizontal, all as will be described in greater detail subsequently.

The liquid ice system further includes a circulating conduit designated partly by a solid line showing of a pipe and partly by dashed arrows indicated at 18. Liquid ice from the compartment 11 is pumped into circulating line 18 as by a pump 19 shown to the left of the ice machine 10 in FIG. 1. The liquid ice will flow through the circulating conduit and thence back into the compartment 11.

Referring now to the lower portion of FIG. 1, there is illustrated in combination with the ice machine 10 a conveyor means 20 having a work surface 21 preferably in the form of a wire mesh belt. Work surface 21 is driven by appropriate sprockets at each end of the elongated conveyor so as to move cartons of vegetables or poultry from one end of the conveyor to the other. In FIG. 1, one such carton is illustrated at 22 on the work surface 21.

Conveyor structure 20 further includes an overhead structure 23 supporting a portion of said circulating conduit passing above the work surface 21. This portion of the circulating conduit 18 comprises a branch portion 24 shunting a main portion of the conduit 18 incorporating a manually operable valve 25. The arrangement is such that by closing down the valve 25, more of the liquid ice will be caused to flow through the branch tubing 24. In addition to the overhead structure supporting a conduit portion described, the conveyor means also includes a liquid ice accumulating tank 26 below the work surface 21.

Still referring to FIG. 1, there is shown depending downwardly from the branch line 24 of the circulating conduit applicator means in the form of a probe 27 which may be manually manipulated and will be described subsequently and a principal liquid ice automatic applicator 28. Applicator 28 incorporates a pneumatic valve 29 arranged to be automatically operated in response to the box 22 passing a given position along the conveyor.

More particularly, there are provided first and second switches 30 and 31 arranged to be successively operated by physical engagement with the carton 22. The first switch 30 is arranged to operate a valve schematically indicated at 32 via the dashed line connection 33. Valve 32 when opened by the switch 30 upon engagement of the switch by the carton will apply air pressure to an air chamber 35 and thence line 36 to the pneumatic valve 29 of the applicator 28. However, valve 29 remains closed until such time as the second switch 31 is engaged by the box 22. At this point in time, the valve 29 will be opened by way of the connection indicated by the dashed line 37. Liquid ice will then fall from the applicator 28 onto the top surface of the vegetable or poultry contents of the box 22.

The valve 29 will remain open until the first switch 30 is free of the box 22; that is, after the box 22 has been passed beyond the first switch 30. This switch will then automatically close cutting off the pneumatic air supply to the valve 29. Thereafter, when the box 22 leaves the switch 31, the valve 29 will be closed.

By positioning the first and second switches 30 and 31 a distance apart less than the length of the box 22 travelling thereover, the arrangement is such that liquid ice will only be disspelled from the applicator 28 when the box 22 is fully under the applicator. In other words, operation of the first switch 30 itself will not permit liquid ice to fall from the applicator, but rather it is necessary to wait until the second switch 31 is operated at which time the box 22 if fully under the applicator 28. Also, the first switch 30 will be caused to close when the box 22 leaves the same and in such position, the box is still under the applicator 28 while closure takes place so that again it is assured that there will be no liquid ice falling on the work surface 21 in front of or to the rear of any one carton 22.

Any liquid ice that does spill over or splash is collected in the tank 26.

Beyond the overhead structure 23 along the conveyor 20 there is provided appropriate means for closing the carton flaps and compressing the ice poured onto the top surface of the ingredients. This structure takes the form of converging members 38 which fold the side flaps inwardly and a roller 39 arranged to compress the forward and rear flaps and ice within the carton 22.

The foregoing operations are all carried out automatically.

While not shown, the conveyor would include at its front and rear portions appropriate water spray means for keeping ice off of the sprocket drives for the work surface 21 and also to keep ice from freezing up in the intersices of the wire mesh making up the work surface. Excess water from the spray will be collected in the bottom of the conveyor such as by the sloping floor 40 and all returned to the tank 26 wherein such water along with any ice passing through the work surface is recirculated back to the liquid ice machine 10 by way of conduit 41.

Figure 2:
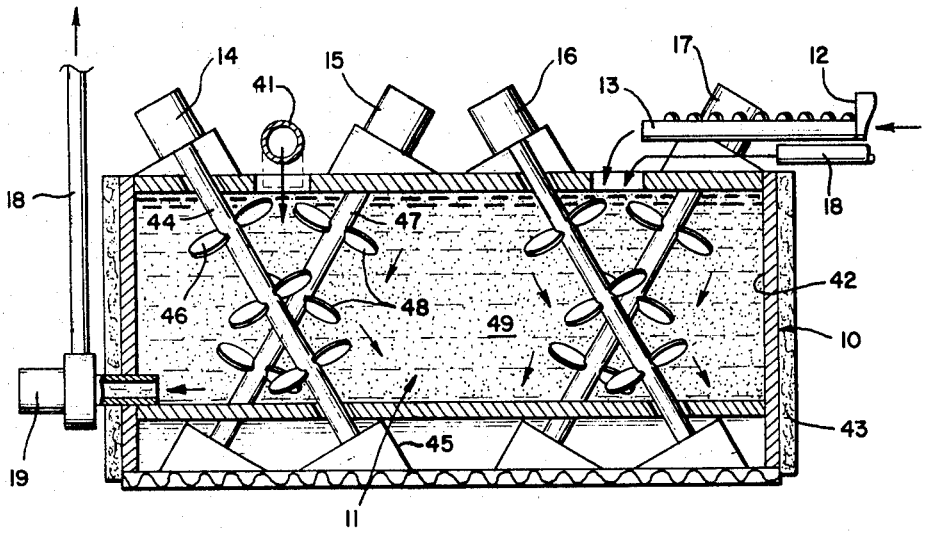
FIG. 2 is a fragmentary cross section taken in the direction of the arrows 2—2 of the liquid ice machine.

Referring now to FIG. 2, further details of the icing machine itself will be evident. In the embodiment as shown, the structure is designed particularly for making liquid ice to be used in refrigerating poultry products and towards this end, the interior side walls are lined with stainless steel as indicated at 42. Outside the stainless steel there is provided insulation 43.

In addition to the provision of the stainless steel side walls, associated piping and valves contacted by the liquid ice are also lined with stainless steel when poultry is to be refrigerated to meet necessary sanitation requirements.

In FIG. 2 four mixing devices are provided operated by the four motors previously referred to and indicated by the numerals 14 through 17. Thus, motor 14 drives shaft 44 extending into the compartment 11 at an angle of 60° to the horizontal. Shaft 44 terminates in a bearing 45 in the floor portion of the compartment and is provided with laterally extending impeller means 46 so oriented that when the shaft 44 is rotated, the ice slurry within the compartment 11 will be driven downwardly. This action tends to counteract the tendency for the ice to float so that a homogeneous mixture is maintained.

The motor 15 similarly rotates a shaft 47 also angulated at 60° but in an opposite sense to the shaft 44 and is disposed adjacent to the opposite side wall. Shaft 47 similarly includes impeller mixer blades 48 oriented to again drive the slurry in a downward direction.

The liquid ice slurry itself is indicated at 49 within the compartment 11.

Because of the large size of the compartment, the additional motors 16 and 17 are provided connected to appropriate shafts provided with impeller means to assure that all of the contents within the compartment are thoroughly mixed. These latter additional shafts are in spaced parallel relationship to the shafts 44 and 47 respectively as shown.

The outlet for the liquid ice by way of the pump 19 to circulating conduit 18 is shown in the lower left of FIG. 2, the return of the circulating line being shown at the upper right portion. The return line for the accumulating tank under the conveyor is shown in cross section at 41.

An appropriate hood is provided to prevent foreign matter from dropping through the top opening into the compartment 11. This hood would normally cover the inlet screw 13 and return pipe 41 but is illustrated only partially in FIGS. 1 and 2 with two rectangular openings shown to avoid obsecuring other portions of the drawing.

Figure 3:
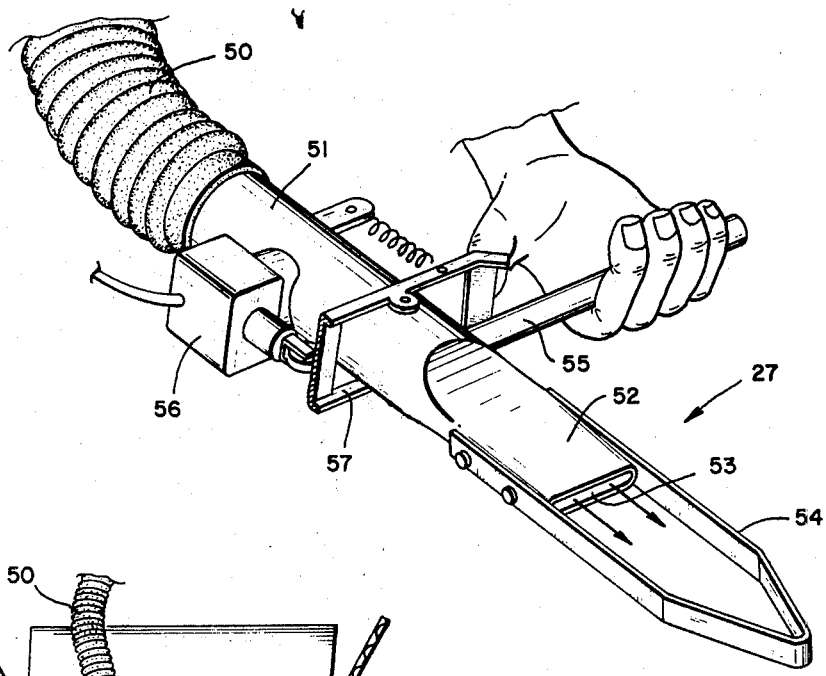
FIG. 3 is an enlarged fragmentary perspective view of an applicator probe looking in the direction of the arrow 3 of FIG. 1.

Referring now to FIG. 3, further details of the probe 27 previously described in FIG. 1 are shown. Basically, the probe 27 would be utilized on the assembly line for re-icing operations; that is, again refrigerating partially thawed out ingredients in cartons. In this respect, the probe is so designed as to effect a more efficient and greater penetration for a given amount of liquid ice than is possible with the system heretofore described of simply permitting the liquid ice to flow into the top surface of the ingredients as by way of the applicator 28 of FIG. 1.

The probe 27 as shown in FIG. 3 includes a flexible tube portion 50 arranged to connect to the source of liquid ice such as the conduit portion disposed over the conveyor or to any other appropriate source of liquid ice which might be available in the area. A stiff cylindrical metal tube 51 connects to the flexible tube 50 at one end and has its other end flattened as at 52 to define an elongated oval liquid ice exit opening 53. An appropriate U-shaped frame member 54 serves as a piercing guide and is secured on either side of the flattened portion 52 with the U-portion extending forwardly of the oval opening 53.

For the particular probe illustrated in FIG. 3, there is also provided a handle 55 for manual holding and working of the probe together with a pneumatic valve 56 and trigger switch 57 for the valve. With this arrangement, a user can manually control the application of liquid ice by opening and closing the pneumatic valve 56 by way of the trigger using his thumb as illustrated. The liquid ice when the valve is opened will be emitted from the elongated oval opening 53 as indicated by the arrows.

Figure 4:
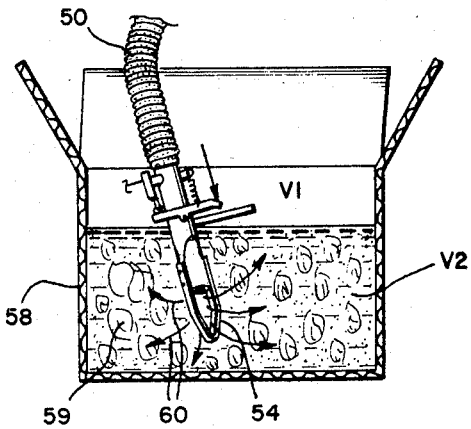
FIG. 4 is a cross section of a carton containing vegetables illustrating the use of the probe of FIG. 3 in applying liquid ice to refrigerate the vegetables.

Referring now to FIG. 4, there is illustrated a use of the probe with respect to a carton 58 containing vegetables or poultry 59 to be refrigerated. First, the probe is manually forced down into the vegetable or poultry 59, the frame structure 54 serving as a leading edge or guide to spread the poultry and provide for relatively simple penetration. The action is such that the oval opening in the probe is positioned well below the surface such that when the operator now opens up the valve to permit liquid ice to flow through the device, this liquid ice will spread out in all directions to uniformly penetrate the entire volume of the vegetable or poultry. This penetrating action is indicated by the arrows 60.

It can be appreciated that since the liquid ice is introduced at approximately the middle of the mass of vegetables or poultry and spreads out in all directions, penetration is substantially more uniform than would be the case where the liquid ice simply poured in on top and worked down by gravity. In this latter arrangement, proper refrigeration is realizable but it usually takes a relatively large amount of liquid ice poured onto the top surface to assure that the same will penetrate all the way down to the bottom of the carton.

By using the probe, substantially less liquid ice is required because of the positioning of the initial outlet portion for the liquid ice.

In FIG. 4, there is indicated the volume of liquid ice at V2 which is sufficient to provide for proper refrigeration. Heretofore, without the use of the probe, a total volume V1 corresponding to the entire volume of the carton was normally necessary for the liquid ice.

It can thus be seen that by using the probe, less liquid ice is necessary and thus less weight is involved as well as less volume. The feature of enabling less volume to be used permits a smaller sized carton which saves on shipping costs and the like.

The probe described is also very useful for immediate refrigeration of ingredients previously packaged in the field. In this respect, vegetables or other food items are placed in cartons and the flaps of the carton closed up. However, there is usually a slot either in the top of the carton between the opposing edges of the flaps or to the side of the carton where appropriate gripping handles are provided into which the probe may conveniently be inserted when the closed carton or box is brought in from the field. It will thus be understood that while FIG. 4 shows the probe being inserted in a box with the flaps open, in many icing operations the probe will simply be inserted through a top slot in the box or a side slot.

It should be understood with respect to this invention that while vegetables and poultry have been referred to primarily as edible food items to be refrigerated, other items such as fish as well as non-edible items requiring refrigeration could also be treated with the liquid ice in accord with the teachings of this invention.

It is to be further appreciated that the present invention has provided a greatly improved automatic liquid ice system incorporating features not only improving the refrigeration of vegetables all in an automatic manner, but for the first time permitting the use of liquid ice for the refrigeration of poultry. As a consequence, certain preliminary cooling steps can be eliminated. For example, the hydro-cooling of vegetables is no longer necessary when the liquid ice of this invention is utilized.

I claim:

1. An automatic liquid ice system including, in combination:

(a) an icing machine for making liquid ice, said machine comprising a compartment with means for receiving crushed ice; means for pulverizing said ice; agitating means in said compartment for constantly stirring the water and ice to maintain it in a liquid state; a circulating conduit external of said compartment; and a liquid ice pump for pumping said liquid ice from said compartment through said circulating conduit and back to said compartment;

(b) a conveyor means having a work surface for moving boxes of various items to be refrigerated for shipment, said conveyor means further including an overhead structure supporting a portion of said circulating conduit above said work surface; and a liquid ice accumulating tank below said work surface; and (c) liquid ice applicator means connected to said portion of said circulating means and including liquid ice valve means; and means for controlling said valve means automatically responsive to movement of said box on said work surface past a given position to apply liquid ice from said applicator means into said box to cover said items therein, excess liquid ice, if any, being collected in said accumulator tank for return of said compartment.

2. A system according to claim 1, in which said agitating means includes at least two separate motors mounted on top of said compartment and having elongated shafts extending at opposite 60° angles to the horizontal into said compartment adjacent to opposite sides, each shaft having laterally extending impeller paddles and terminating in a floor bearing in said compartment said paddles constantly pushing liquid ice downwardly in the compartment to counteract the tendency for the ice to float to maintain a substantially homogeneous mixture of liquid ice.

3. A system according to claim 2, in which the side walls of said compartment are lined with stainless steel, said boxes to be treated with liquid ice containing poultry items.

4. A system according to claim 2, in which said agitating means includes two additional separate motors respectively mounted with their shafts running in generally parallel spaced relationship to the first mentioned shafts to provide a total of four mixing motors for said compartment.

5. A system according to claim 1 in which said portion of said circulating conduit includes a main liquid ice passage and a branch liquid ice passage, said main liquid ice passage having a regulating valve therein so that adjustment of said regulating valve controls the volume of liquid ice passing through said branch passage; said applicator means being connected to receive liquid ice from said branch passage; said means connected to the valve means automatically responsive to movement of the box past a given position including first and second spaced switches on said conveyor arranged to be successively physically engaged by the box as it moves along the conveyor, said valve means on said applicator being pneumatically operated, the first of said switches providing pneumatic air pressure to said valve and the second of said switches opening said valve whereby when said second valve is operated by movement of said box, it is properly positioned under said applicator to receive liquid ice and when the first mentioned valve recloses upon passing of said box, pneumatic air is removed so that it is assured that liquid ice will not be passed from said applicator after said box has moved out from under the applicator.

6. A system according to claim 1, in which said liquid ice applicator means includes a probe member, said probe member including a flexible conduit portion mounted to said circulating conduit portion, a rigid cylindrical metal tube connected to said flexible conduit at one end and flattened at its other end to define an oblong exit opening; and a U-shaped frame structure defining a piercing guide secured to said tube.ahead of said oblong opening to pierce through items in a box on said conveyor and pass liquid ice into the central region of the contents of said box, said probe being utilized for re-icing operations.

* * * * *